US005766351A

United States Patent [19]

Lin

[11] Patent Number: 5,766,351

[45] Date of Patent: Jun. 16, 1998

[54] SIZING MECHANISM

[76] Inventor: Tsai-shou Lin, Suite 2, 7F, No. 95-8 Chang Ping Road, Sec. 1, Taichung, Taiwan

[21] Appl. No.: 591,700

[22] Filed: Jan. 25, 1996

[51] Int. Cl.[6] ..... B05C 1/06

[52] U.S. Cl. ..... 118/256; 118/37; 118/40; 118/236; 118/244; 118/258; 118/263; 118/DIG. 17; 156/510; 156/524; 156/534; 156/575; 156/578

[58] Field of Search ..... 118/37, 40, 236, 118/244, 256, 258, 263, DIG. 17; 427/207.1, 428; 156/510, 524, 534, 575, 578

[56] References Cited

U.S. PATENT DOCUMENTS

| | | | |
|---|---|---|---|
| 475,324 | 5/1892 | Lafean et al. | 118/258 |
| 1,310,355 | 7/1919 | Krafft | 118/40 |
| 2,745,376 | 5/1956 | Nowak | 118/40 |
| 2,747,540 | 5/1956 | Moore | 156/524 |
| 3,131,278 | 4/1964 | Rosenthal | 156/510 |
| 3,979,242 | 9/1976 | Holland et al. | 156/575 |
| 5,230,737 | 7/1993 | Takada et al. | 118/258 |

*Primary Examiner*—Donald E. Czaja
*Assistant Examiner*—Michael P. Colaianni

[57] ABSTRACT

A glue sizing mechanism includes a container secured to the bottom of a pair of walls. A coil of sheet member is rotatably supported on the walls. A roller has the ends slidably engaged in the walls and a pair of cams are engaged with the ends of the roller for moving the roller up and down. A cover is pivotally secured to the walls for covering the roller and includes a panel having a groove for engaging with a knife. A rule includes two extensions secured to the walls for measuring the width of the sheet member.

1 Claim, 4 Drawing Sheets

SIZING MECHANISM

BACKGROUND OF THE INVENTION

The present invention relates to a sizing mechanism, and more particularly to a mechanism for sizing glue and for simultaneously cutting the sheet member.

Typical wall papers are normally wound in a coil and are unwound from the coil for applying glue thereon and for attaching to the walls of the houses or buildings. However, it is difficult to apply to the glue evenly onto the wall paper. In addition, a portion of the glue may be dried when the other part of the wall paper is applying glue thereon. Furthermore, it will be difficult to apply glue onto the marginal portions of the wall paper. It is time consuming to apply glue onto the wall paper. In addition, it is difficult to cut the wall paper to different width.

The present invention has arisen to mitigate and/or obviate the afore-described disadvantages of the conventional wall paper glue conditions.

SUMMARY OF THE INVENTION

The primary objective of the present invention is to provide a glue sizing mechanism for evenly applying glue onto the sheet member and for allowing the sheet member to be cut easily.

In accordance with one aspect of the invention, there is provided a glue sizing mechanism comprising a pair of walls, a container secured to the bottom of the walls, and a roller rotatably provided between the walls. A shaft is rotatably supported on the walls for supporting a coil of sheet member thereon, the walls each includes a channel formed in middle portion and each includes a plurality of projections formed in an outer portion, a pair of casings are pivotally secured to end portions of the roller and slidably engaged in the channels, a pair of cams rotatably secured to the walls and engaged with the casings for moving the casings and the roller up and down, a pair of knobs are secured to the cams for rotating the cams, the knobs each includes a spring member having a cusp for engaging with the projections so as to prevent the knobs and the cams from rotating relative to the walls, a cover is pivotally secured to the walls for covering the roller, the cover includes a panel having a groove formed therein for engaging with a knife, and the walls each includes an oblong hole formed in a front portion, a rule includes a pair of extensions extended therefrom, a pair of fastening members engaged through the oblong holes and secured to the extensions for securing the rule to the walls and for adjusting the rule relative to the walls. The glue may be evenly applied onto the sheet member and the sheet member can be easily cut to different width.

Further objectives and advantages of the present invention will become apparent from a careful reading of a detailed description provided hereinbelow, with appropriate reference to accompanying drawings.

DESCRIPTION OF THE PREFERRED EMBODIMENT

Figure 1:
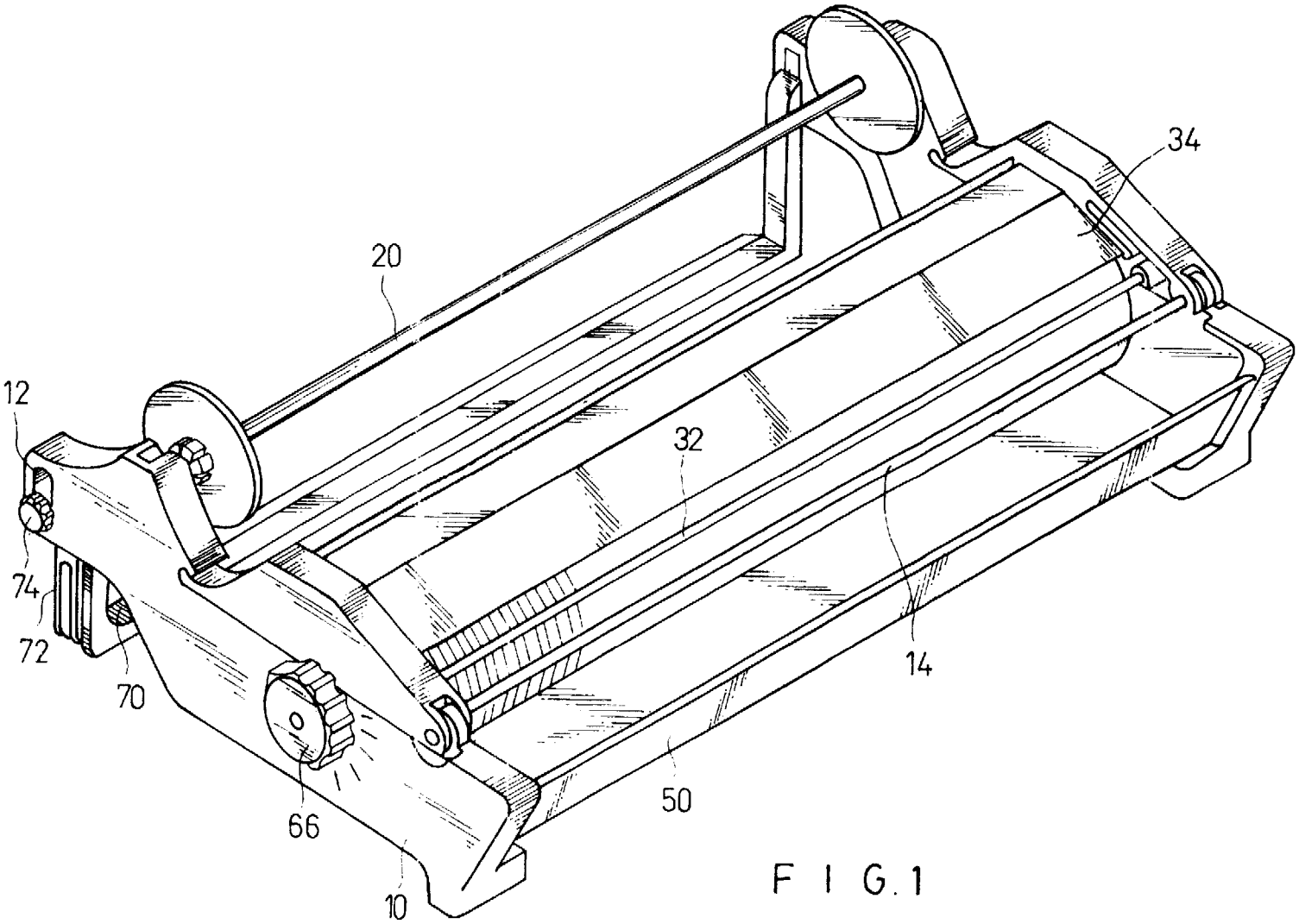
FIG. 1 is a perspective view of a glue sizing mechanism.
Figure 2:
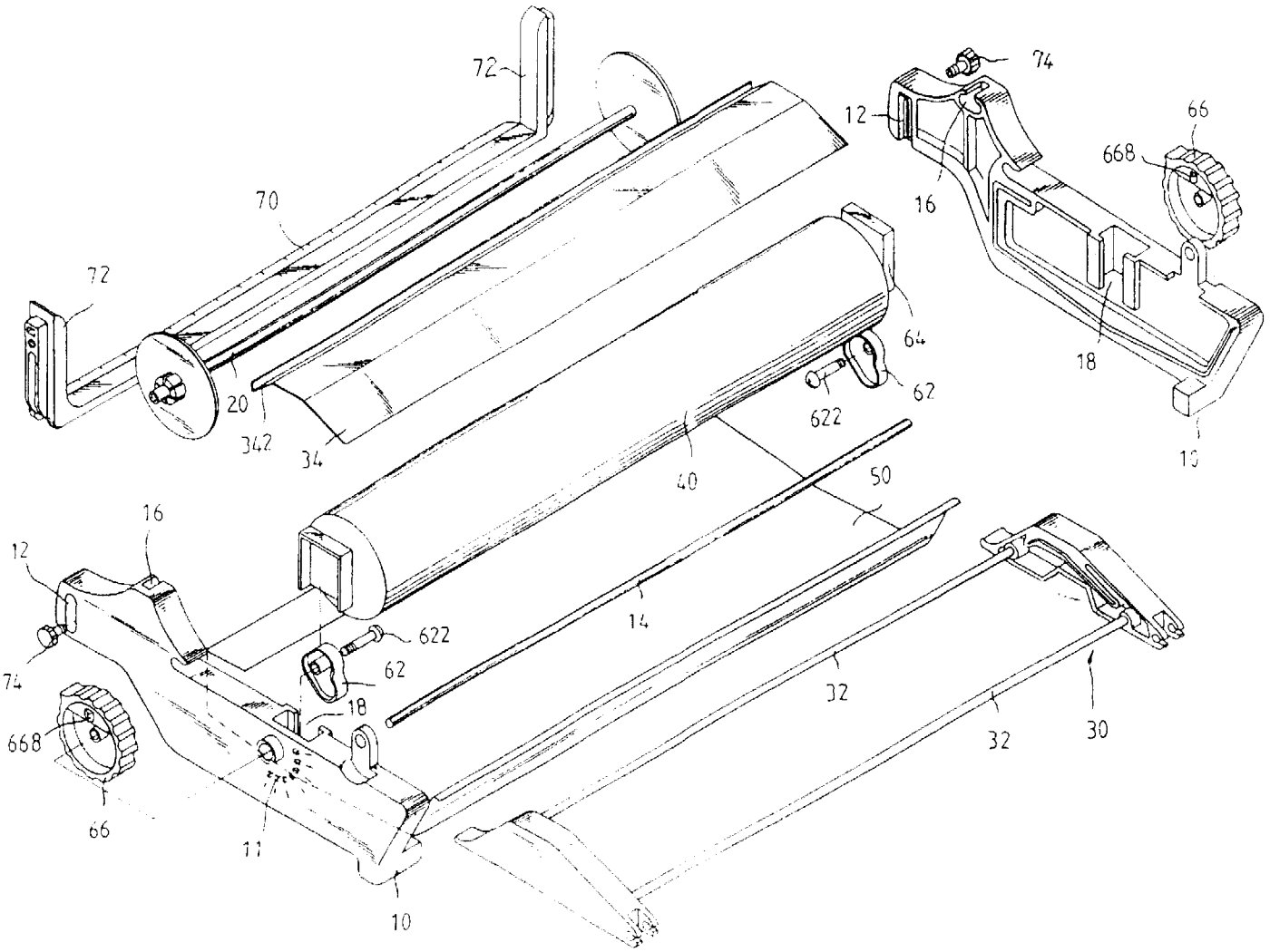
FIG. 2 is an exploded view of the glue sizing mechanism.
Figure 4:
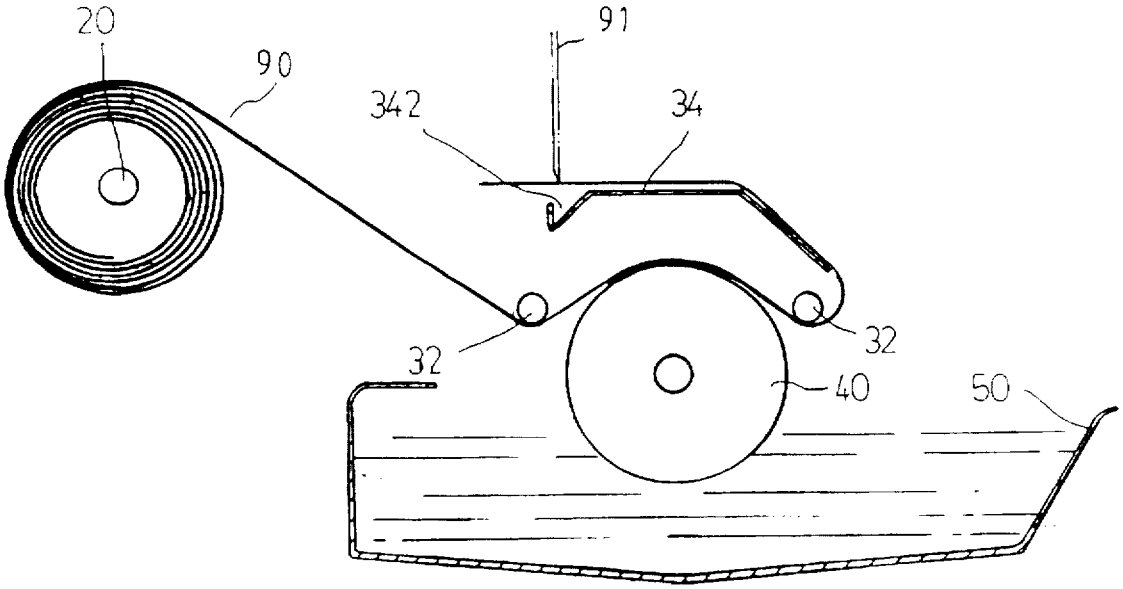
FIG. 4 is a schematic view illustrating the application of the glue sizing mechanism.
Figure 5:
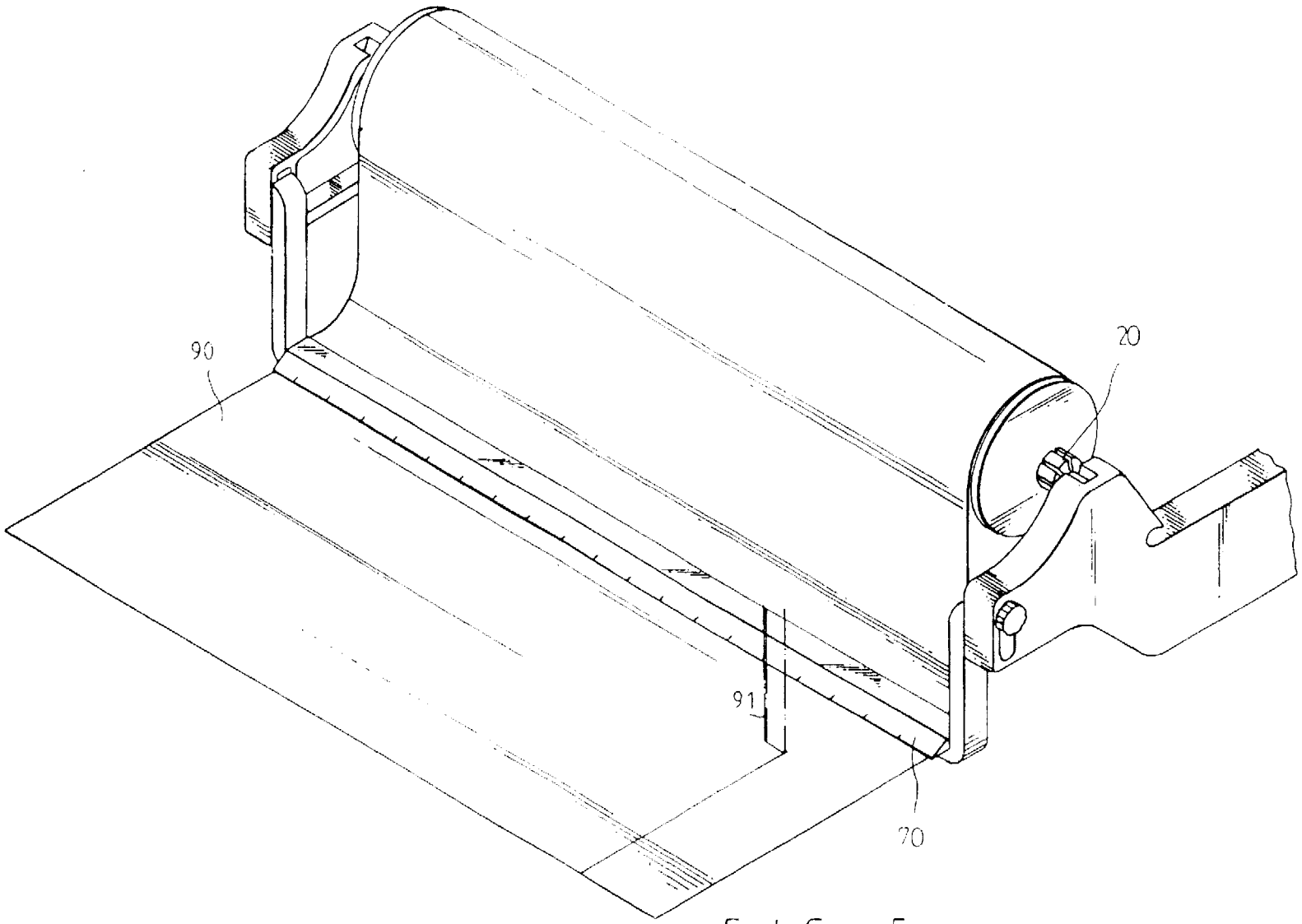
FIG. 5 is a perspective view illustrating the application of the glue sizing mechanism.

Referring to the drawings, and initially to FIGS. 1, 2 and 4, a glue sizing mechanism in accordance with the present invention comprises a pair of walls 10 each including an oblong hole 12 formed in the front portion for engaging with screws 74. A rule 70 includes two extensions 72 extended from the side portion. The screws 74 are engaged with the extensions 72 for securing the rule 70 to the walls 10 and for adjusting the rule 70 up and down along the oblong holes 12. A container 50 is secured between the bottoms of the walls 10 for containing glue therein. A rod 14 is secured on the rear portion of the walls 10. A pair of orifices 16 are formed in the middle front portion of the walls 10 for rotatably receiving the end portions of a shaft 20 onto which a coil of sheet, member 90 is wound (FIGS. 4 and 5). The walls 10 each includes a channel 18 formed in the inner and middle portion thereof and each includes a number of projections 11 formed on the outer and middle portion thereof and arranged in a curve.

A roller 40 is rotatably provided between the walls 10. Two casings 64 are rotatably secured to the end portions of the roller 40 such that the casings 64 are rotatable relative to the roller 40. The casings 64 are slidably engaged in the channels 18 and movable up and down along the channels 18. A pair of cams 62 are rotatably secured to the walls 10 by bolts 622. A pair of knobs 66 are rotatably secured to the walls 10 and secured to the cams 62 by the bolts 622 such that the cams 62 and the knobs 66 rotate in concert. The cams 62 are engaged with the casings 64 for moving the casings 64 and the roller 40 up and down when the knobs 66 are rotated by the users.

Figure 3:
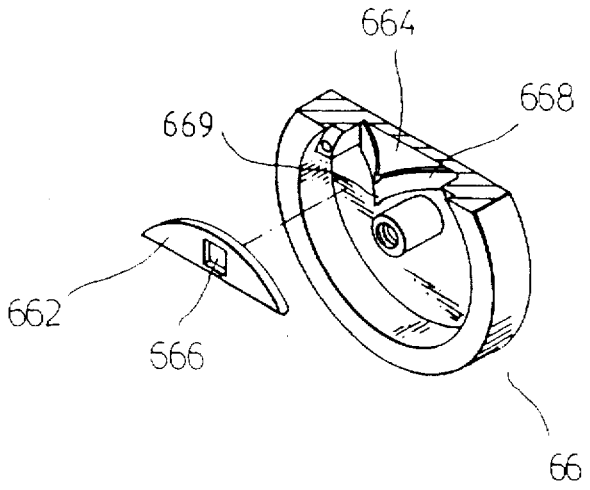
FIG. 3 is a partial exploded view of a knob.

Referring next to FIG. 3, the knobs 66 each includes a plate 662 secured thereto so as to form a room 664 for receiving a V-shaped spring member 668 therein. The plates 662 each includes an opening 666 formed therein for engaging with the cusps 669 of the spring members 668 such that the cusps 669 may extend outward of the plates 662 for engaging with the projections 11 so as to position the knob 66 relative to the walls 10 and so as to prevent the knob 66 and the cam 62 from rotating relative to the walls 10. A cover 30 is engaged on top of the roller 40 and has one edge pivotally coupled to the rod 14. The cover 30 includes two poles 32 secured therein for engaging with the sheet member 90 and for pressing the sheet member 90 to engage with the roller 40 (FIG. 4). The cover 30 includes a panel 34 secured therein for covering the roller 40 and for preventing dirt from dirtying the roller 40. The panel 34 includes a groove 342 formed therein (FIGS. 2 and 4) for engaging with a knife 91 which may provided for cutting the sheet member 90.

In operation, as shown in FIG. 4, the roller 40 has a lower portion engaged with the glue contained in the container 50. The sheet member 90 is unwound from the shaft 20 and engaged through the poles 32 and the roller 40 such that the glue stuck onto the roller 40 may be applied onto the sheet member 90 when the sheet member 90 is moved or pulled and when the roller 40 is rotated by the sheet member 90. The reverse surface of the sheet, member 90 where no glue is applied thereon may be engaged on the panel 34. The knife 91 may be engaged with the groove 342 for cutting the sheet member 90 at the suitable position.

Referring next to FIG. 5, when the width of the sheet member 90 does not fit the users requirement, a knife 91 may be engaged on the sheet member 90 according to the position relative to the rule 70 for cutting the sheet member 90 to suitable width when the sheet member 90 is pulled out by the users.

When quantity and the level of the glue is decreased, it is only required to rotate the knobs 66 so as to move the casings 64 and the roller 40 downward such that the roller 40 may be lowered to engaged with the glue having lowered level.

Accordingly, the glue sizing mechanism in accordance with the present invention may be provided for evenly applying glue onto the sheet member and for allowing the sheet member to be cut easily.

Although this invention has been described with a certain degree of particularity, it, is to be understood that the present disclosure has been made by way of example only and that numerous changes in the detailed construction and the combination and arrangement of parts may be resorted to without departing from the spirit and scope of the invention as hereinafter claimed.

I claim:

1. A glue sizing mechanism comprising a pair of walls, a container secured to a bottom of the walls, a roller rotatably provided between the walls;

a shaft rotatably supported on the walls for supporting a coil of sheet member thereon, the walls each including a channel formed in middle portion and each including a plurality of projections formed in an outer portion, a pair of casings pivotally secured to end portions of the roller and slidably engaged in the channels, a pair of cams rotatably secured to the walls and engaged with the casings for moving the casings and the roller up and down, a pair of knobs secured to the cams for rotating the cams, the knobs each including a spring member having a cusp for engaging with the projections so as to prevent the knobs and the cams from rotating relative to the walls, a cover pivotally secured to the walls for covering the roller, the cover including a panel having a groove formed therein for engaging with a knife, and the walls each further including an oblong hole formed in a front portion, a rule including a pair of extensions extended therefrom, a pair of fastening members engaged through the oblong holes and secured to the extensions for securing the rule to the walls;

whereby said coil of sheet member is gradually sized with glue by said roller and is cut off into suitable sizes.

* * * * *